US005822924A

United States Patent [19]

Wijninga et al.

[11] Patent Number: 5,822,924

[45] Date of Patent: Oct. 20, 1998

[54] BURGLARY-PREVENTATIVE PROFILE SET AND A PROFILED STRIP FOR APPLICATION THEREIN

[76] Inventors: Maarten Hendrik Wijninga, Prins Bernhardlaan 11, NL-1111 EP Diemen; Nicole Therese Hartwijk, Zeemanlaan 27, NL-1171 BC Badhoevedorp; Christian Jacques Van Bruggen, Keizersgracht 722, NL-1017 EW Amsterdam, all of Netherlands

[21] Appl. No.: 836,281

[22] PCT Filed: Nov. 2, 1995

[86] PCT No.: PCT/NL95/00377

§ 371 Date: May 29, 1997

§ 102(e) Date: May 29, 1997

[87] PCT Pub. No.: WO96/14490

PCT Pub. Date: May 17, 1996

[30] Foreign Application Priority Data

Nov. 2, 1994 [NL] Netherlands ..... 9401825

[51] Int. Cl.[6] ..... E05D 11/00

[52] U.S. Cl. ..... 49/383

[58] Field of Search ..... 49/460, 462, 383, 49/400, 401

[56] References Cited

U.S. PATENT DOCUMENTS

| | | | |
|---|---|---|---|
| 301,221 | 7/1884 | Devers | 49/383 X |
| 1,973,461 | 9/1934 | Barringer | 49/383 X |
| 2,263,495 | 11/1941 | Hare . | |
| 3,271,063 | 9/1966 | Garrett . | |
| 3,634,962 | 1/1972 | Peterson | 49/383 |

FOREIGN PATENT DOCUMENTS

| | | |
|---|---|---|
| 0 667 438 | 8/1995 | European Pat. Off. . |
| 1 509 158 | 3/1969 | Germany . |
| 32 19 196 | 12/1983 | Germany . |
| WO 89/04907 | 6/1989 | WIPO . |

*Primary Examiner*—Jerry Redman
*Attorney, Agent, or Firm*—Young & Thompson

[57] ABSTRACT

A burglary-preventative profile set for a panel (3) which is movably mounted with respect to a frame (4), comprising two profiled strips (1,2) which mutually cooperate so as to cover a chink (5) between the panel (3) and the frame (4), at least in the closed position of the panel (3). The chink is thus rendered inaccessible to a jemmy, crowbar or other such instrument. Both strips (1,2) comprise a U-profile with a short leg (8) and a long leg (9), whereby the long leg (9) comprises an inward buckle (93) which acts as a transition between two mutually parallel parts (91,92), which parts (91,92) lie in displacement with respect to one another across at least the thickness (d) of the strip (1,2).

5 Claims, 3 Drawing Sheets

BURGLARY-PREVENTATIVE PROFILE SET AND A PROFILED STRIP FOR APPLICATION THEREIN

BACKGROUND OF THE INVENTION

The invention relates to a burglary-preventative profile set for a panel which is movably mounted with respect to a frame, comprising two elongated profiled strips for respective attachment to the panel and the frame, which strips mutually cooperate, at least when in the mounted state, so as to cover a chink between the panel and the frame, at least in the closed position of the panel. The invention also relates to a profiled strip for application in such a set.

Such a profile set is generally employed in the case of doors and windows which are attached to a frame so as to be turnable or slidable, and is generally manufactured from metal or another robust material. In such a scenario, one of the two strips is mounted on the lock side of the window or the door, whereas the other strip is attached to the neighboring cornice of the frame. In the closed state of the panel, the two strips engage, or otherwise cooperate in such a manner as to completely cover the chink between the panel and the frame from the outside. The said chink is hereby made inaccessible to a jimmy, crowbar or other such instrument with which the panel could be forced out of the frame.

A set of the type stated in the preamble is known from an international patent application in the name of the current applicant, which was laid open to public inspection under the number 89/04907. The set described therein comprises two profiled metal strips which, at least in the closed state of the panel, close around one another at the lock side of the panel at the location of the chink, thereby closing off the chink. The strips are mounted on the outside of the panel, and thereby render the chink externally inaccessible to a jimmy or other such instrument.

As it is, the known burglary-preventative profile sets offer efficacious burglary prevention. However, in many cases, the known sets are such that the screw or clamping organs with which the strips are attached can also be accessed in the closed state, in the case one or both strips. For this reason, use should be made of burglary-preventative organs, which are relatively expensive and which do not allow subsequent adjustment of the strip concerned.

It is true that the known set of two purely U-shaped strips does not have this drawback, but the covering of the mounting holes in such a set makes mounting considerably more difficult. especially in the case of the strip which is to be attached to the frame.

SUMMARY OF THE INVENTION

It is inter alia an object of the invention to provide a burglary-preventative profile set of the type stated in the preamble, in which the attachment apertures are completely covered in the closed state, and which does not suffer from this drawback. A further object of the invention is to provide a burglary-preventative profile set of the type stated in the preamble, which consists of two profiles of the same form and consequently offers industrial-economic advantages. Another object of the invention is to provide a profile set of the type stated in the preamble, which is relatively compact. A further object of the invention is to provide a profile set of the type stated in the preamble, which, if so desired, can be adjusted with relative ease. Moreover, it is an object of the invention to provide a profile set of the type stated in the preamble, which offers increased burglary prevention.

To this end, a profile set of the type stated in the preamble is characterized according to the invention in that both profiled strips comprise a U-profile with a short leg and a long leg, and that the long leg comprises an inward buckle such that the long leg comprises two parts which are practically mutually parallel and which, at least across the thickness of the profile, lie in displacement with respect to one another and pass into one another via the buckle.

The fact that both strips in this set are of the same form is of great advantage from the point of view of profile production, whereby it is now no longer necessary to adapt machines or to employ a second, relatively expensive mold, thereby resulting in faster production and, consequently, lower costs. However, the set according to the invention not only leads to evident industrial-economic advantages: the set additionally offers excellent burglary-preventative properties. In the closed state of the panel, the long leg of each of the strips lies over the short leg of the other strip. The strips in the set consequently demonstrate a double interlock, whereby, for the profile set according to the invention, in the closed state of the panel, the chinks mutually located between the two strips are virtually inaccessible to a jimmy or other such instrument. Not only is the chink between the panel and the frame, in the closed state of the panel, thus rendered inaccessible to a jimmy or other such instrument, but, most importantly, the set itself is internally inaccessible, whereby an additional barrier is created. As a result, the profile set offers double burglary prevention, and must be doubly jarred open in order to get at the chink between the panel and the frame. In addition, the set according to the invention cannot be removed on a strip-by-strip basis: in order to remove the set, one must work concurrently on both strips, which acts as a further deterrent to burglary.

The mounting holes, and the fixing organs located therein for the purpose of attaching the strips, are also completely hidden in the closed state, and thus inaccessible. As a result, ordinary screws can be employed as the fixing organs. Not only are normal screws considerably less expensive than burglary-preventative mono-directional screws, but normal screws are also easier to manage for the average do-it-yourself enthusiast. An additional advantage of the use of normal screws is thus that, if so desired, the strips can afterward be screwed loose and screwed tight as required, which considerably simplifies subsequent adjustment.

The invention succeeds, moreover, in realising this combination of advantages in an extremely compact and a particularly slender form, which is not only highly desirable from an aesthetic point of view but, above all, almost always allows the set according to the invention to fit in practice between an existing frame and any door or window unit which may be present. Moreover, the bends in the strips lend additional stability and strength thereto, whereby it is possible to achieve either increased burglary prevention or savings on material.

In order to simplify mounting the strips in the case of this preferential embodiment, a first part of the long leg of the U-profile preferably extends beyond the short leg thereof. ln this manner, the mounting holes which are created in the first part of one of the two profiles, and the screw or binding organs to be placed therein, are always directly accessible to a screwdriver or other such instrument placed at right angles thereto. This considerably simplifies mounting as compared to, for example, the known set of two purely U-shaped strips, in which the mounting apertures in one of the two strips are only accessible to such an instrument at an angle.

In practice, it transpires that the strips in the set sometimes yield with respect to one another after long usage, which can impede opening and closing of the panel in some cases.

Subsequent adjustment of the strips in the known profile set is however, virtually impossible. A preferential embodiment of a burglary-preventative profile set according to the invention is less sensitive to this yielding tendency and, above all, is in no way impeded when it comes to subsequent (re) adjustment of the set. This preferential embodiment is characterized according to the invention in that at least one of the profiled strips is provided with a number of slotted apertures for the acceptance of fixing organs for the purpose of attaching the strip, and that the slotted apertures extend in a direction transverse to the longitudinal direction of the strip.

The inventors have recognized that the yielding of both strips with respect to one another is caused by expansion and contraction of the frame, and particulary the panel, as a result of varying weather conditions. By ensuring, in accordance with this embodiment, that at least the strip which is to be attached to the panel is attached thereto by means of the aforementioned slotted apertures, it is possible to accommodate in the fixing apertures the expansional and contractional behavior of at least the panel, thereby removing the principal cause of long-term yielding of the strips. Moreover, thanks to the slotted holes, and the possibility of using "ordinary" (i.e. non-burglary-preventative) fixing organs, the strip concerned can be adjusted with relative ease at any time.

In a particular embodiment, both profiled strips are embodied with slotted apertures which extend in a direction transverse to the longitudinal direction of the profile associated therewith. In that case, the occurrence of warp in the panel, as well as any warp in the frame, can be accommodated in the slotted apertures, and both strips can, if so desired, be subsequently adjusted at will, which is of immediate advantage during placement of the set.

In the interest of optimal attachment of the strips, the slotted apertures therein are preferably disposed at regular distances along at least substantially the entire length of the strip.

BRIEF DESCRIPTION OF THE DRAWINGS

The invention will now be further elucidated with the aid of a number of embodiments and a drawing, in perspective, wherein.

The figures are purely schematic, and are not drawn to scale. In particular, some dimensions are strongly exaggerated for the purpose of clarity. Corresponding parts in the drawing are denoted by the same reference number, in so far as this is possible.

DESCRIPTION OF THE PREFERRED EMBODIMENTS

Figure 1:
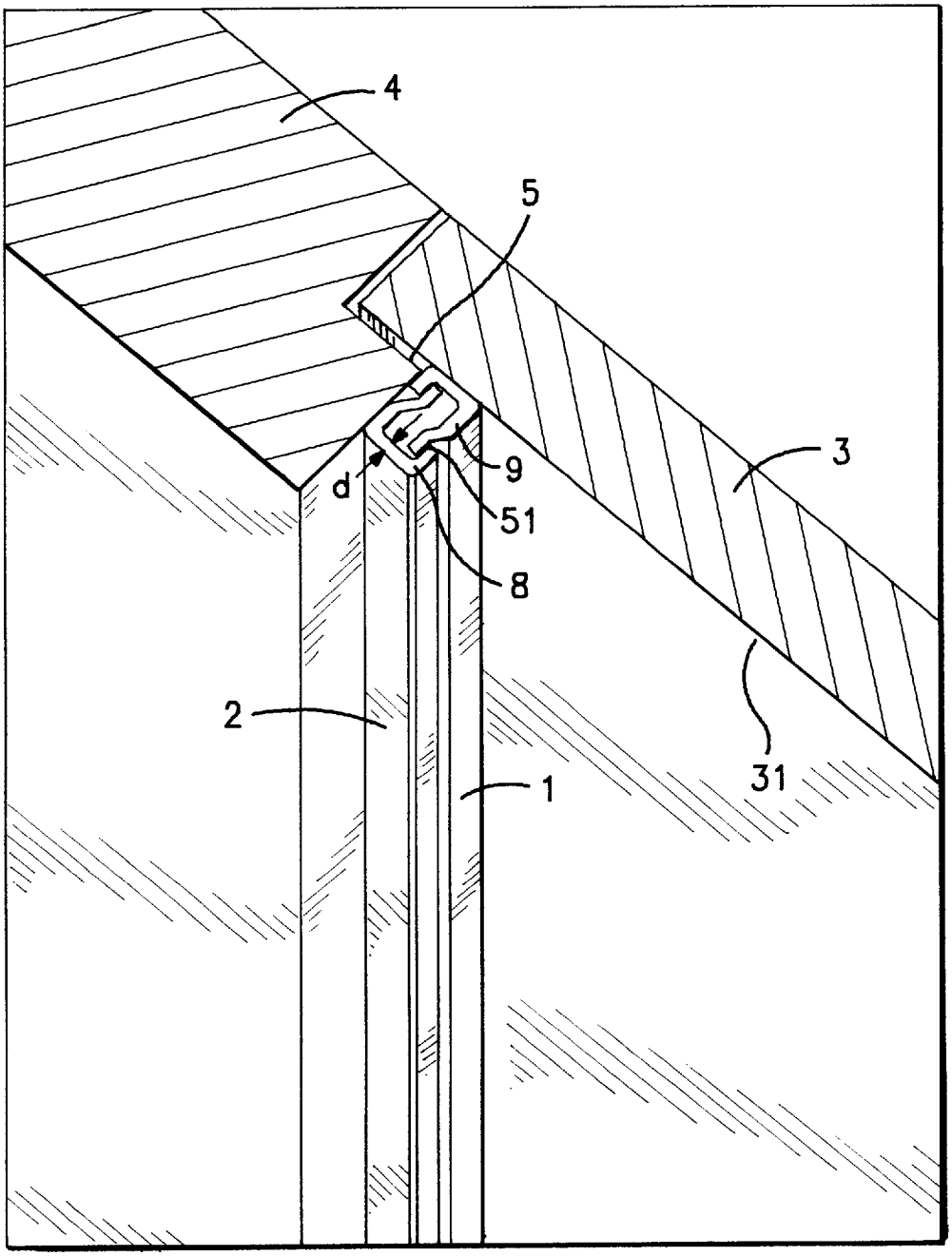
FIG. 1 depicts a preferential embodiment of a burglary-preventative profile set according to the invention.
Figure 2:
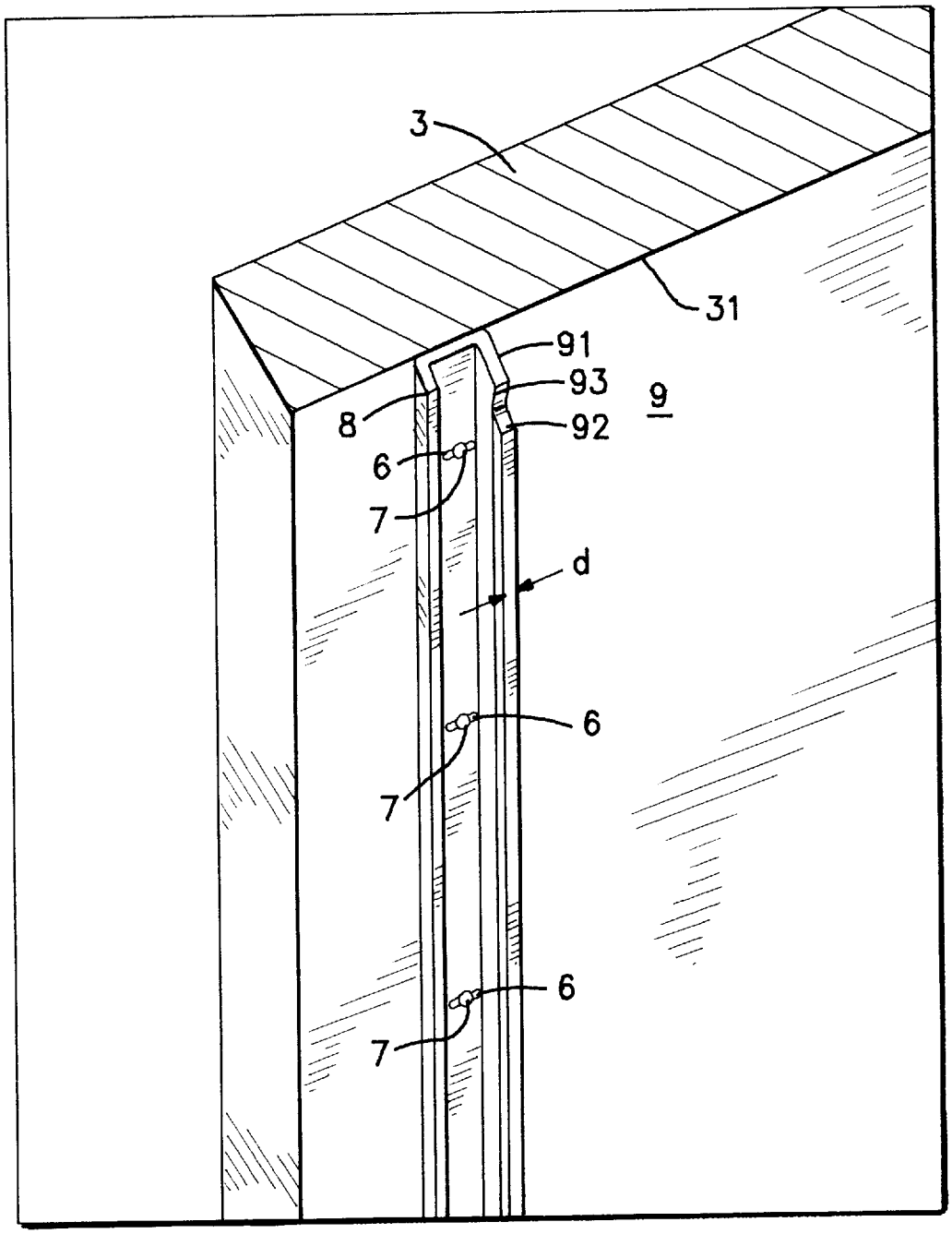
FIG. 2 depicts a first profiled strip of the set in FIG. 1.
Figure 3:
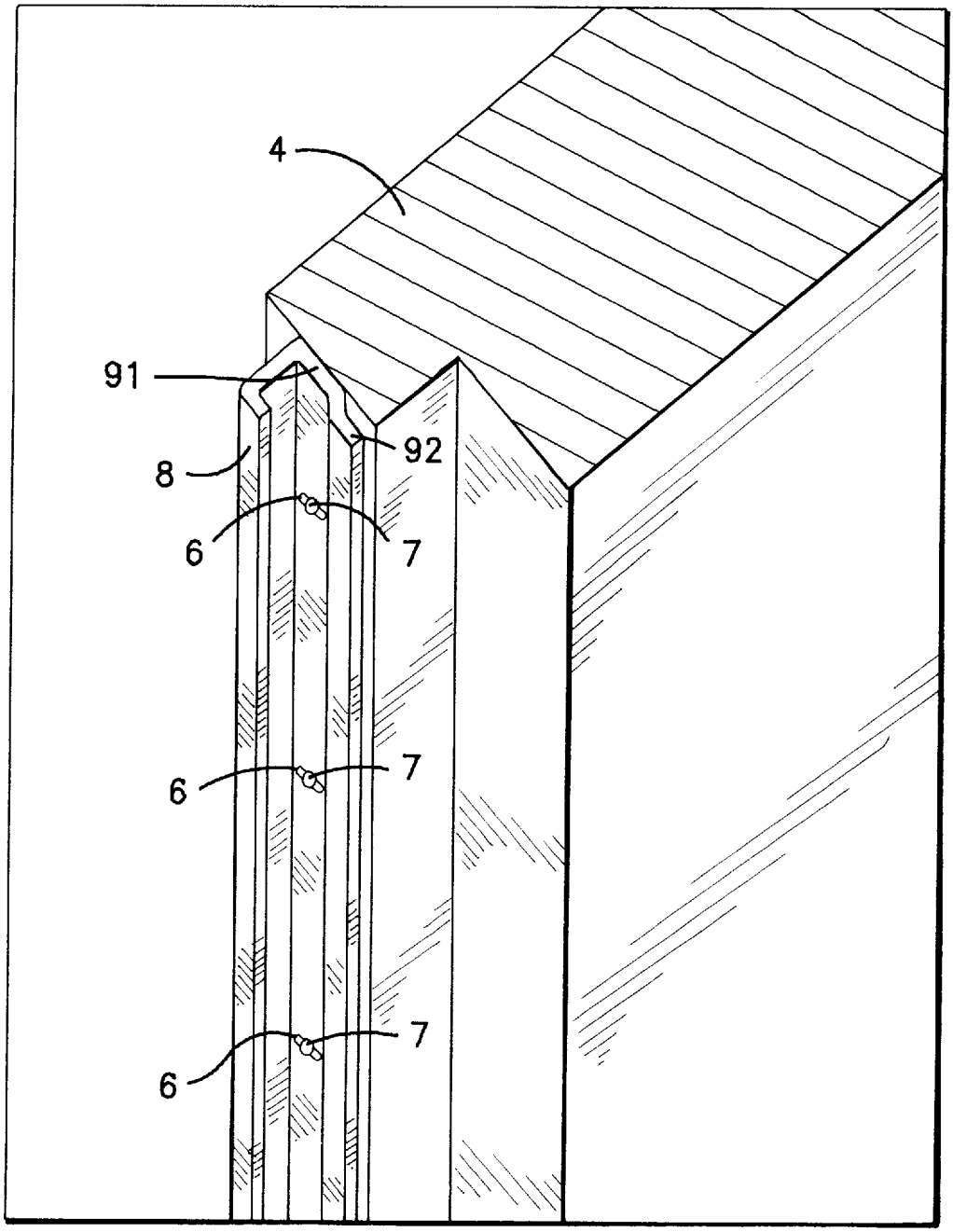
FIG. 3 depicts a second profiled strip of the set in FIG. 1.

In FIG. 1, a burglary-preventative profile set is employed on an inward-hinging panel 3, such as a window or door, for example. The set comprises two substantially identical profiled strips 1,2, which are separately depicted in FIGS. 2 and 3. The employment of identical strips, in so far as this is possible, is particularly economical from the point of view of manufacturing technology, since it necessitates the use of only one, relatively expensive manufacturing mold or roll.

A first strip 1 of both strips is mounted on the outside 31 of the panel 3, and a second strip 2 is attached to the frame 4. For purposes of clarity, only the lock sides of the panel 3 and the frame 4 are depicted. The strips 1,2 both comprise a U-profile with a short leg 8 and a long leg 9. The long leg 9 is thereby provided with an inward buckle 93 which acts as a transition between two mutually parallel parts 91,92, which parallel parts 91,92 lie in displacement with respect to one another across at least the thickness d of the strip.

In the depicted closed state of the panel 3, both profiles 1,2 interlock, whereby the long leg 9 of each of the profiles 1,2 lies over the short leg 8 of the other profile. In this manner, not only is the split 5 between the panel and the frame adequately sealed, but, above all, the set itself is internally inaccessible to a jimmy or other such instrument, whereby an additional barrier is created and, moreover, the fixing organs can not be reached from outside. The strips 1,2 can therefore be attached using "ordinary" fixing organs, such as screws or nails, and thus do not necessitate the use of anti-burglary variants thereof. Not only does this lead to an important reduction in costs: in addition, the fixing screws can be screwed loose and screwed tight once again at any time, which simplifies subsequent adjustment of the strips 1,2. Moreover, the chink 51 between the strips themselves is, as a result of the fact that its entrance is faced towards the panel 3, practically inaccessible to a jimmy or other such instrument, as a result of which the depicted set offers particularly adequate burglary-prevention. Moreover, the set achieves these advantages in a particularly compact form, which is inter alia of importance from an aesthetic point of view, and which almost always allows the set to be used in conjunction with an existing door or window unit.

So as to prevent the two strips 1,2 themselves from being forced apart using a jimmy or other such instrument, the space between them should, in principle, be as small as possible. Accordingly, the play between both strips 1,2 is only slight. As a result of the inevitable effects of weather, the frame 4. and the panel 3 in particular, will both contract and expand to a certain extent. So as to prevent consequent displacement of the strips 1,2 with respect to one another, with the attendant significant risk that, in the long term, the panel 3 will no longer open and close properly, it is preferable, such as in this embodiment, to embody the first strip 1 with slotted mounting apertures 6 which extend in a direction transverse to the longitudinal direction of the strip 1 and with which the strip 1 is attached to the panel 3. In the interest of rigid attachment, the mounting apertures 6 are thereby disposed at regular distances along substantially the entire length.

As a result of the slotted form, the screws 7 have a certain play in the apertures 6, whereby the panel 3 can warp in the transverse direction without the first strip 1 being displaced with respect to the second strip 2. If, despite this, the first strip 1 nevertheless is displaced, so that the panel 3 can no longer be opened and closed freely, then the strip 1 can be adjusted at any time, thanks to the slotted form of the apertures 6. This also guarantees satisfactory opening and closing of the panel in the long run.

Because the frame 4 warps to a considerably smaller extent in the transverse direction than does the panel 3, and because an axial displacement of the second profile 2 has less effect on the mobility of the panel 3, it is often unnecessary to provide slotted holes therein, and conventional round apertures for the screw or clamping means 7 will often suffice for attachment of the second strip 2. If so desired, however, it is also possible, as in this example, to provide the second strip 2 with slotted mounting apertures, analogous to the apertures 6 in the first strip 1.

The mutual dimensioning of both legs of the U-profiles, which is responsible for the fact that the first part 91 of the long leg 9 of the second strip, together with the slotted apertures therein, extends beyond the short leg 8 (see FIG. 5), accordingly simplifies the task of mounting, since the apertures 6 are thus completely exposed, and the fixing organs can continually be accessed from a perpendicular direction. In this manner, one avoids having to hammer in nails or screw in screws at an angle.

Although the invention hereabove is further elucidated using only a few embodiments, it will be clear that the invention is in no way restricted to the tendered examples. On the contrary, there are many further variations and working forms possible within the scope of the invention. For example, in all the tendered examples, either both strips or just one of the two strips can be embodied with slotted apertures for the purpose of strip-attachment.

Moreover, it is possible in the case of the profile set according to the invention to provide conventional round attachment apertures in both constituent strips. The set thereby preserves the advantages pertaining specifically to such an embodiment.

In general, the present invention provides a burglary-preventative profile set which is relatively insensitive to possible expansional and contractional behaviour of the panel, and which, above all, lends itself to easy subsequent adjustment. Furthermore, it provides a burglary-preventative profile set which offers exceptionally effective burglary prevention in a relatively compact manner.

What is claimed:

1. A burglary-preventative profile set for a panel which is movably mounted with respect to a frame, the set comprising two elongated profiled strips for respective attachment to the panel and the frame, both said profiled strips comprising a U-profile with a short leg and a long leg, each said long leg comprising an inward buckle such that said long leg comprises two parts which are substantially parallel and which are displaced with respect to one another and pass into one another via the said buckle.

2. A burglary-preventive profile set according to claim 1, wherein a first part of the long leg of the U-profile extends beyond the short leg when said two strips are joined together.

3. A burglary-preventative profile set according to claim 1, wherein at least one of the profiled strips is provided with a number of slotted apertures for the acceptance of fixing organs for the purpose of attaching the one profiled strip, and wherein the slotted apertures extend in a direction transverse to a longitudinal direction of the one profiled strip.

4. A burglary-preventative profile set according to claim 3, wherein the slotted apertures are disposed at regular distances along substantially the entire length of the one profiled strip.

5. A burglary-preventative profile set according to claim 1, wherein both said profiled strips are provided with slotted apertures which extend in a direction transverse to a longitudinal direction of the respective profiled strips.

* * * * *